US008506018B1

(12) United States Patent
Navarro

(10) Patent No.: US 8,506,018 B1
(45) Date of Patent: Aug. 13, 2013

(54) SKID-STEER MOUNTED CONCRETE HAMMER WITH GRAPPLE

(76) Inventor: Gilbert Navarro, Omaha, NE (US)

( * ) Notice: Subject to any disclaimer, the term of this patent is extended or adjusted under 35 U.S.C. 154(b) by 0 days.

(21) Appl. No.: 13/435,972

(22) Filed: Mar. 30, 2012

(51) Int. Cl.
*B28D 1/26* (2006.01)

(52) U.S. Cl.
USPC ..... 299/37.3; 299/69; 414/912; 173/46

(58) Field of Classification Search
USPC ..... 173/46, 29; 414/912; 299/37.3, 299/37.4, 37.5, 69, 70, 100; 37/303
See application file for complete search history.

(56) References Cited

U.S. PATENT DOCUMENTS 4,466,494 A * 8/1984 Hanson ..... 173/46
4,602,821 A * 7/1986 Schaeff ..... 299/67
4,719,975 A * 1/1988 LaBounty ..... 173/46
5,626,457 A * 5/1997 Hickman, Jr. ..... 414/739
5,689,905 A * 11/1997 Ibusuki ..... 37/403
6,517,164 B1 2/2003 White
6,520,592 B1 2/2003 Bobholz
6,764,139 B1 7/2004 Wortman
7,124,838 B2 * 10/2006 Stewart et al. ..... 173/25
7,175,236 B1 2/2007 Pfaff
8,109,709 B1 * 2/2012 Gaetze ..... 414/724
2005/0115638 A1 6/2005 Solesbee
2006/0120848 A1 * 6/2006 Guhr ..... 414/723

* cited by examiner

*Primary Examiner* — David Bagnell
*Assistant Examiner* — Michael Goodwin
(74) *Attorney, Agent, or Firm* — Dennis L. Thomte; Thomte Patent Law Office LLC

(57) ABSTRACT

A concrete hammer having a grapple associated therewith is provided which is mounted on the forward end of the boom arms of a skid-steer vehicle. The grapple is selectively movable between open and closed positions. When the grapple is in its open position, the concrete slab may be positioned between the concrete hammer and the grapple with the grapple then being closed to maintain the concrete slab on the upper end of the concrete hammer. The concrete slab may then be moved to a truck for disposal.

12 Claims, 8 Drawing Sheets

SKID-STEER MOUNTED CONCRETE HAMMER WITH GRAPPLE

BACKGROUND OF THE INVENTION

1. Field of the Invention

This invention relates to a grapple apparatus which is used in combination with a concrete hammer mounted on the forward end of the boom arms of a skid-steer loader.

2. Description of the Related Art

Concrete hammers such as those manufactured by Stanley Hydraulics have been previously mounted on the forward ends of the boom arms of a skid-steer loader such as the Melroe Bobcat loader. The concrete hammer is secured to the forward ends of the boom arms by a quick-attach assembly. The quick-attach assembly normally includes a rear quick-attach mechanism which is mounted on the forward ends of the boom arms and a front quick-attach mechanism which is secured to the rearward end of the hammer. The Stanley Hydraulics hammer includes an elongated hammer frame, having rearward and forward ends. The rearward end of the hammer frame is secured to the forward side of the front quick-attach mechanism and extends forwardly therefrom. A spike-like hammer extends from the forward end of the hammer frame. The quick-attach assembly is pivoted so that the spike-like hammer extends downwardly from the boom arms so that the spike-like hammer may be used to hammer or drill spaced-apart holes in a concrete slab, sidewalk or concrete pavement. The hammer is successively moved by the loader so that a square or rectangular slab portion is separated from the remainder of the concrete slab, sidewalk or concrete pavement.

In the prior art, after a slab has been separated from the remainder of the concrete pavement, slab or sidewalk, the slab is normally further demolished so that the pieces of the slab may be scooped up by a bucket on the forward end of the boom arms of a skid-steer loader and placed in the body of a truck for removal from the site. Applicant previously developed a technique wherein, after a slab was separated from the remainder of the pavement, slab or sidewalk, the support frame of the hammer, which was in a vertically disposed position during the drilling of the slab, is pivotally moved to a horizontal position so that the spike-like hammer and frame of the hammer could be moved beneath the slab so that the slab could be balanced on the upper side of the frame which was then lifted, in the balanced position to the upper end of a truck body. This technique required extreme training and was dangerous since the slab could fall or slide from the upper side of the hammer frame. In fact, Applicant was injured and trapped in the cab of a skid-steer loader when a slab fell backwardly from the hammer frame and pinned him in the cab of the skid-steer loader until the slab could be removed.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

This invention is designed to be used with a skid-steer loader including a pair of forwardly extending boom arms. A rear quick-attach mechanism is pivotally secured, about a horizontal axis, to the forward ends of the boom arms. A front quick-attach mechanism is attached to the rear quick-attach mechanism. The front quick-attach mechanism includes a mounting plate having a rearward side and a forward side. The mounting plate is selectively pivotally movable by the rear quick-attach mechanism between a first position to a second position. In the first position, the mounting plate is generally upright or tilted somewhat. In the second position, the mounting plate is generally horizontally disposed.

This invention also includes a concrete hammer assembly including an elongated support frame, having a forward end, a rearward end, a first side, a second side, an upper end, and a lower end. The rearward end of the hammer support frame is affixed to the mounting plate and extends forwardly therefrom. The second end of the hammer support frame has an elongated hammer spike extending therefrom which is parallel to the longitudinal axis of the support frame.

A grapple mount is secured to the upper end of the support frame rearwardly of the forward end thereof. A plurality of grapple members, having a rearward end and a forward end, are pivotally secured, at their rearward ends, about a horizontal axis, to the grapple mount so that the grapple members are selectively pivotally movable between a first open position and a second closed position with respect to the upper end of the support frame. The grapple members, when in the open position, permit a separated concrete slab to be positioned between the grapple members and the support frame. The grapple members, when in the closed position, engage the upper side of the separated concrete slab positioned between the grapple members and the support frame so that the concrete slab may be lifted and placed in a body of a vehicle for transport.

In the preferred embodiment, the grapple members are pivotally moved between their open and closed positions by a hydraulic cylinder. In the preferred embodiment, the support frame has laterally extending wing portions at the first and second sides thereof.

It is therefore a principal object of the invention to provide a skid-steer mounted concrete hammer with a grapple.

A further object of the invention is to provide a grapple which is associated with a concrete hammer so that a concrete slab may be positioned between the concrete hammer and the grapple and maintained therein so that the concrete slab may be lifted and placed in a truck or disposal.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Figure 1:
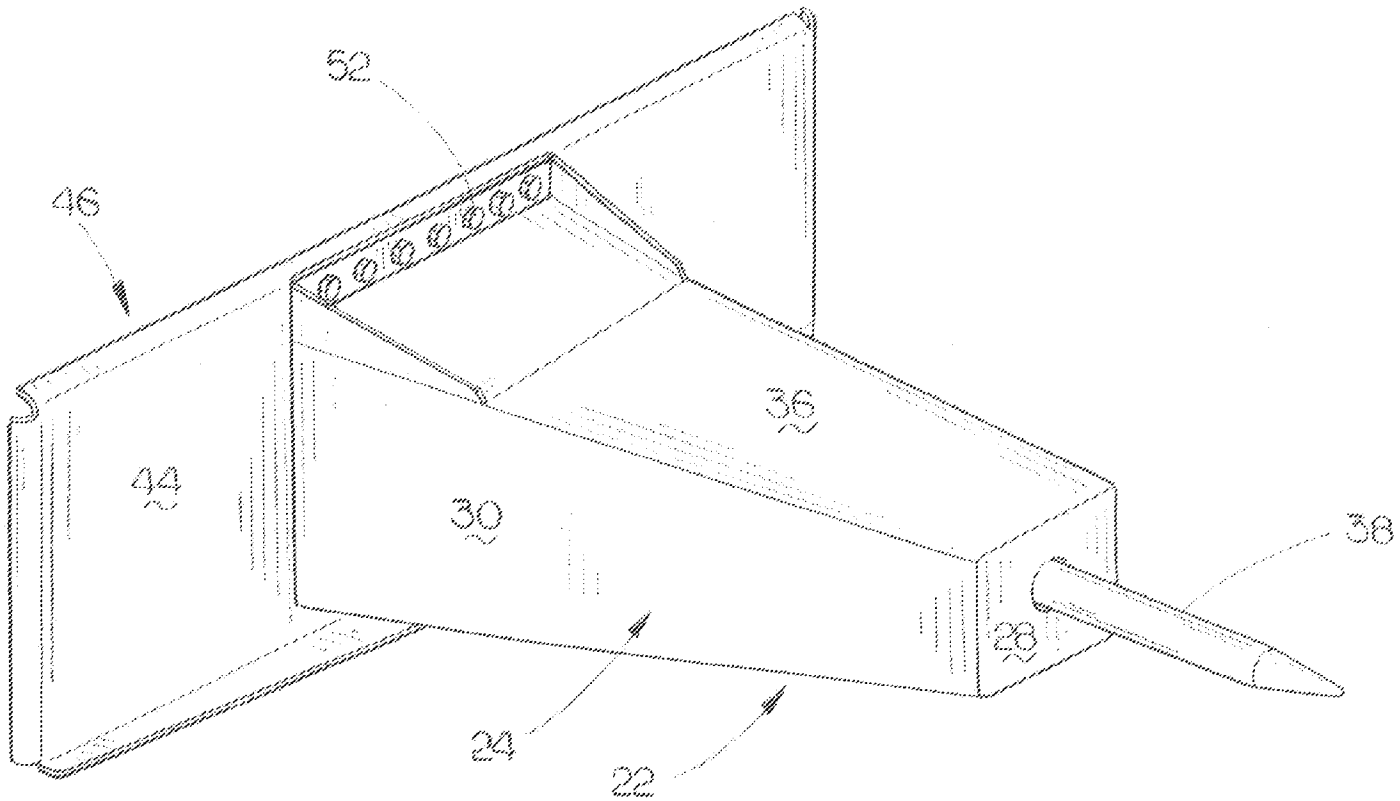
FIG. 1 (PRIOR ART)
FIG. 1 is a front perspective view of a prior art concrete hammer such as manufactured by Stanley Hydraulics.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

The numeral 10 refers to a conventional skid-steer loader such as the Melroe Bobcat loader. Loader 10 includes a pair of boom arms 12 and 14 which may be raised or lowered by hydraulic cylinders 16 in conventional fashion. A rear quick-attach mechanism 18 is pivotally mounted on the forward ends of the boom arms 12 and 14 in conventional fashion and which is pivoted by one or more, usually two, hydraulic cylinders 20 in conventional fashion.

Figure 2:
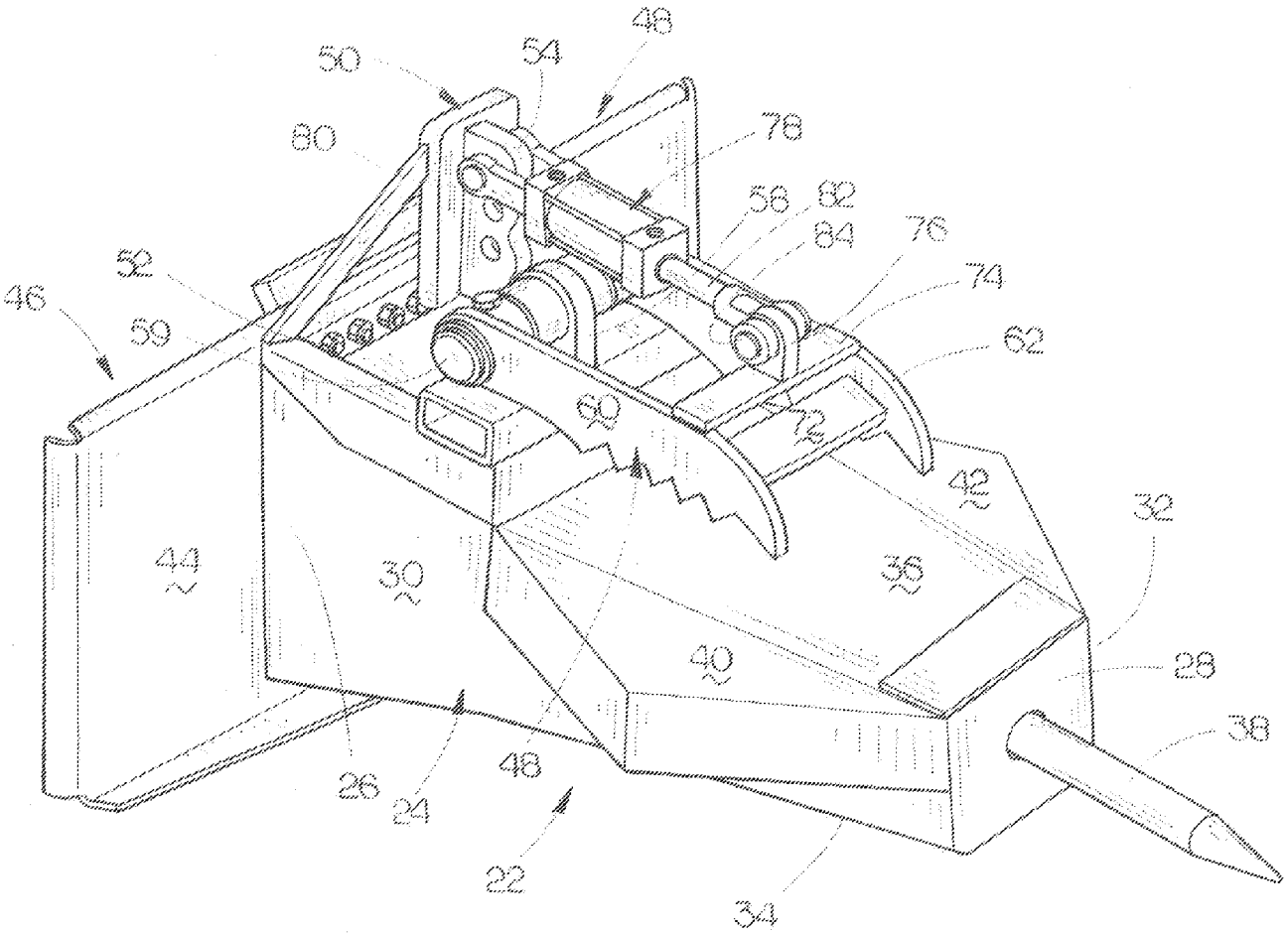
FIG. 2 is a front perspective view of the concrete hammer with the grapple of this invention.
Figure 3:
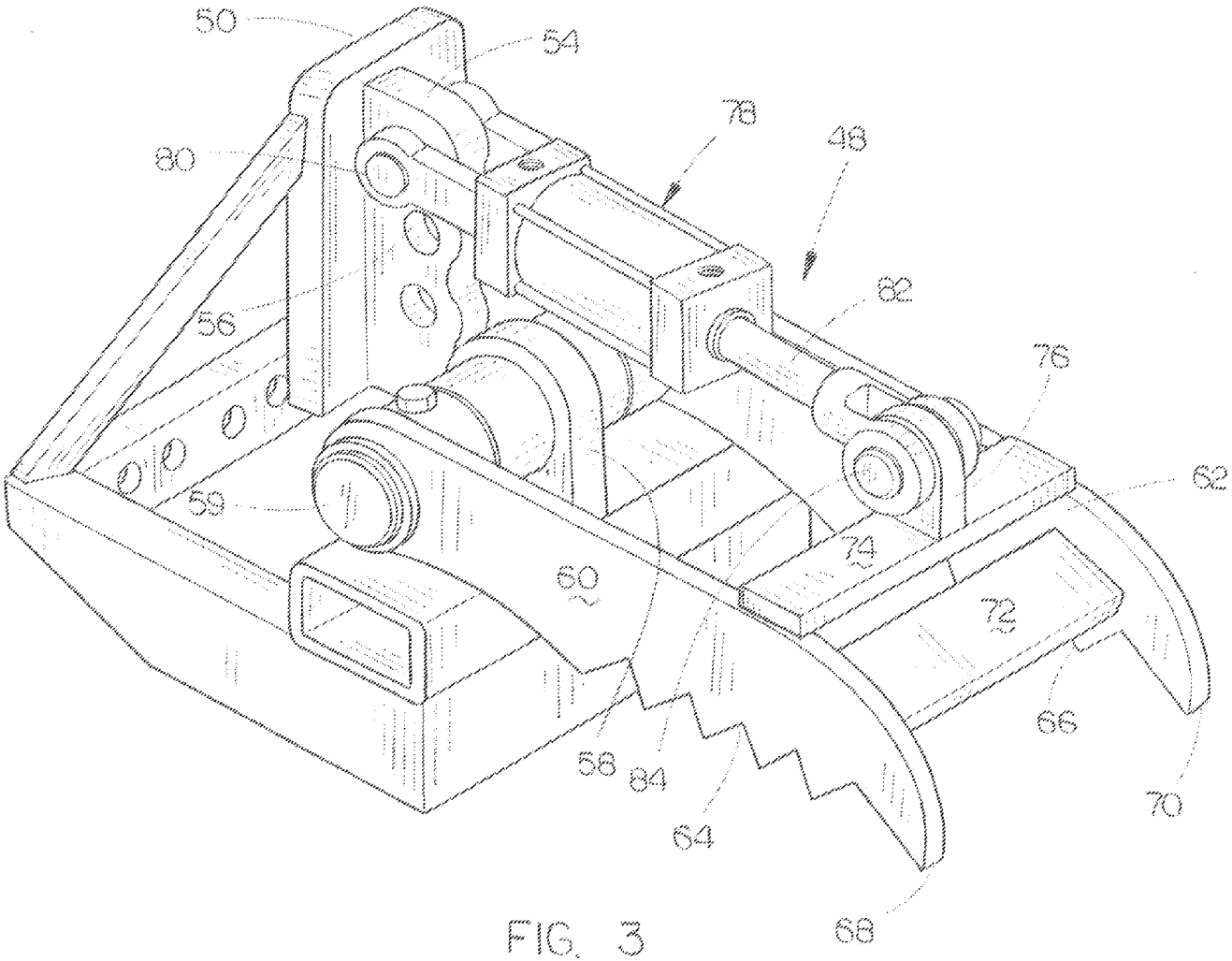
FIG. 3 is a front perspective view of the grapple portion of this invention.
Figure 4:
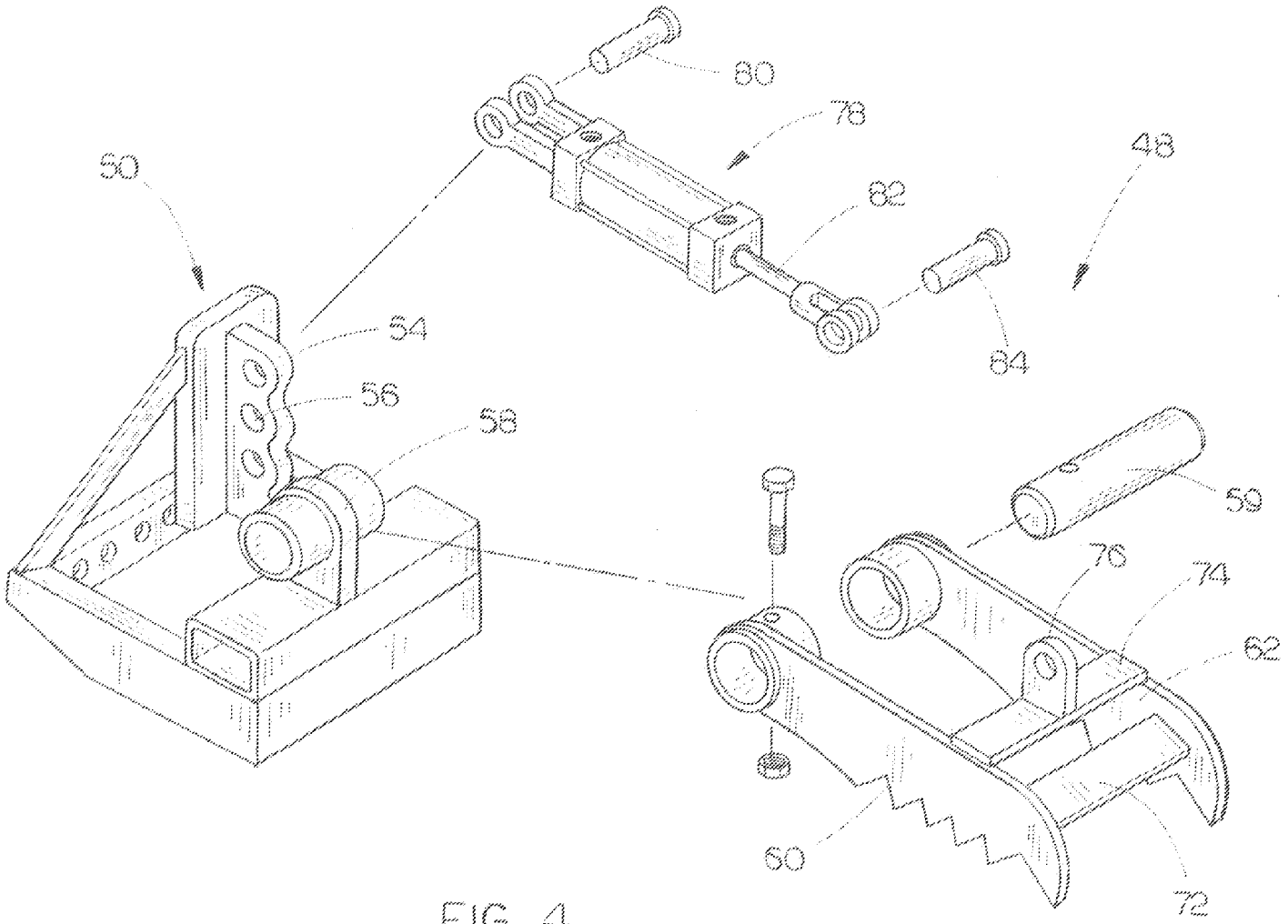
FIG. 4 is an exploded perspective view of the grapple portion of this invention.
Figure 5:
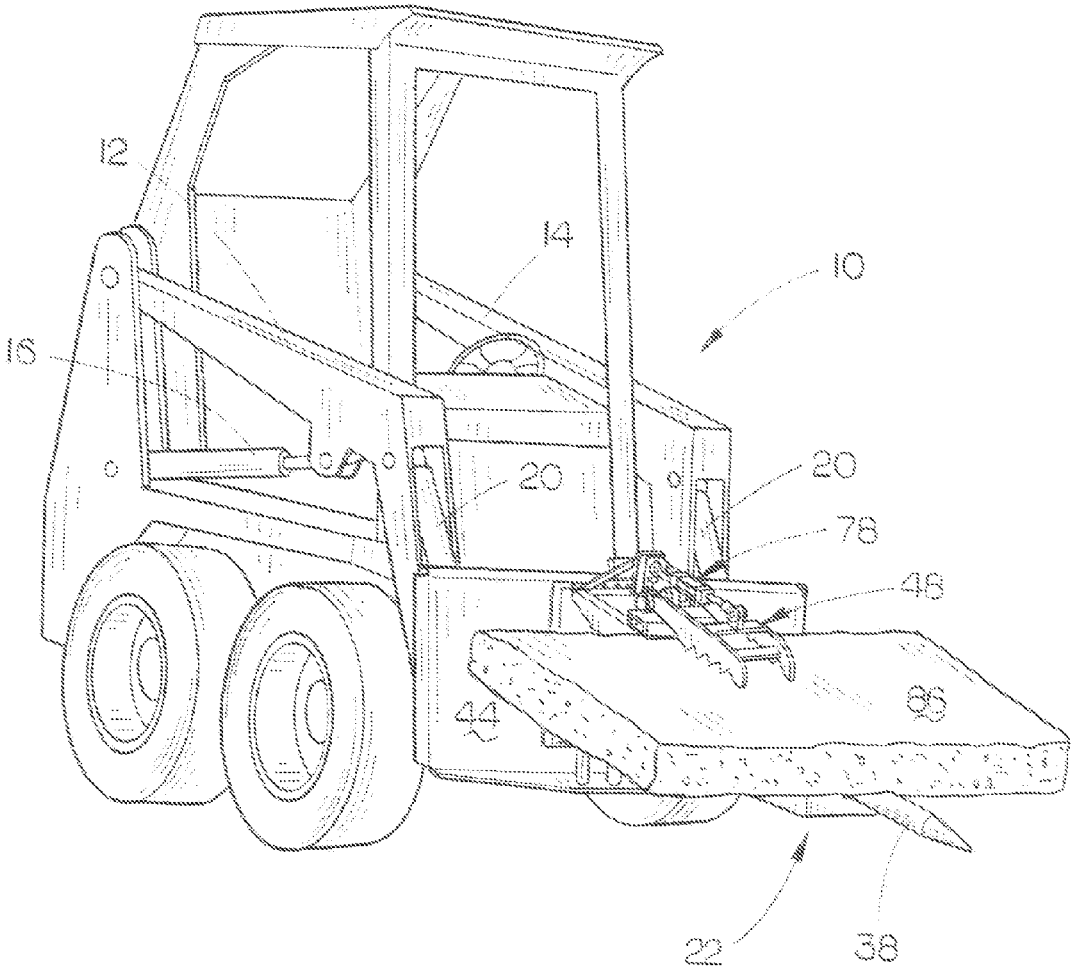
FIG. 5 is a front perspective view of a skid-steer loader having the concrete hammer and grapple of this invention mounted on the forward ends of the boom arms of the loader.

As seen in FIG. 2, the numeral 22 refers to a concrete hammer such as manufactured by Stanley Hydraulics. Hammer 22 includes a hammer frame 24 having a rearward end 26, forward end 28, a right side 30, a left side 32, a lower end 34 and an upper end 36. A spike-like concrete hammer 38 extends from the forward end 28 of hammer frame 24 in conventional fashion.

As seen in FIG. 2, the support frame 24 of the prior art concrete hammer 22 is modified somewhat by welding wings 40 and 42 to the sides 30 and 32 thereof respectively. A conventional mounting plate 44 of a conventional front quick-attach mechanism 46 is welded or otherwise secured to the rearward end 26 of hammer frame 24. Quick-attach mechanism 46 is adapted to be attached to the quick-attach mechanism 18 in conventional fashion.

Figure 6:
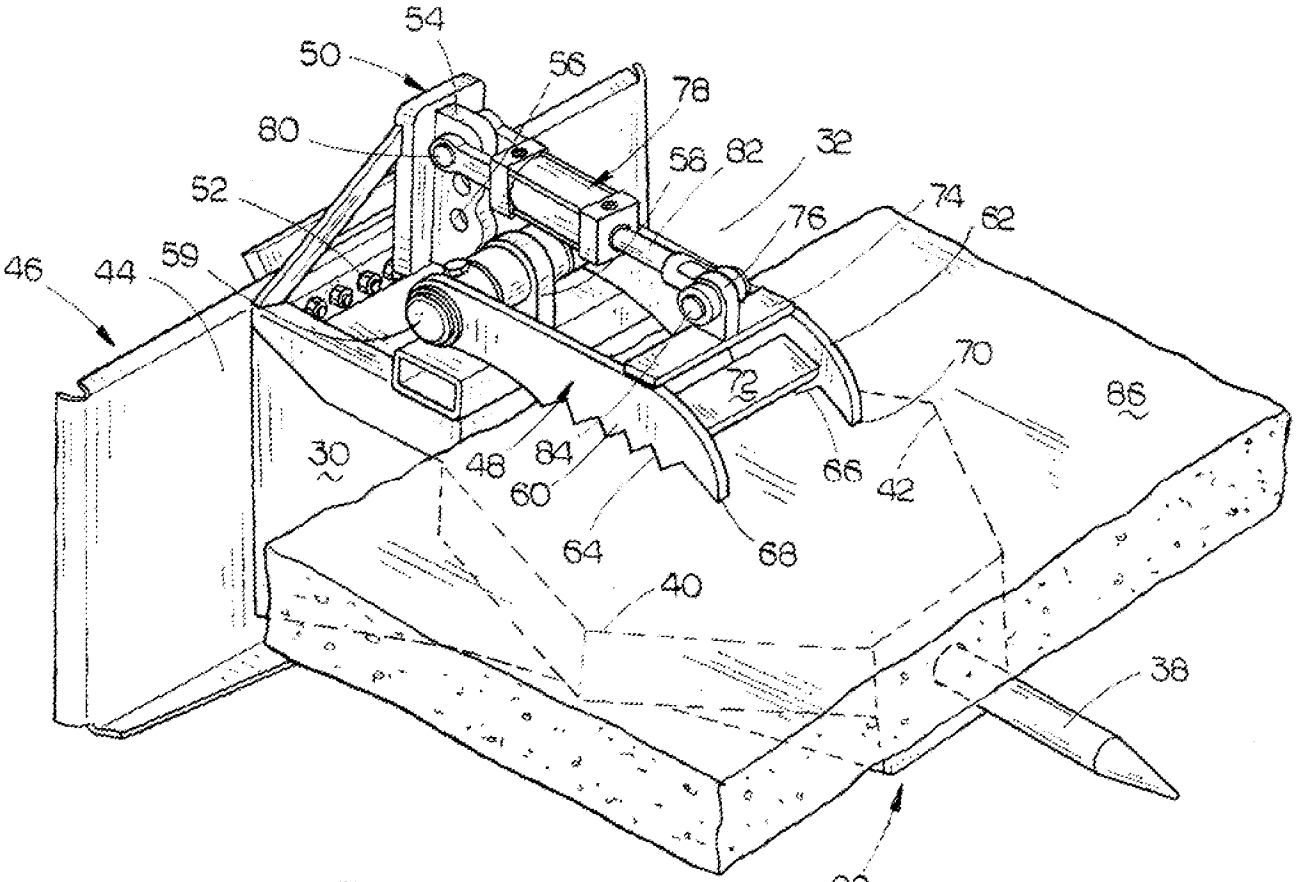
FIG. 6 is a perspective view of the concrete hammer and grapple of this invention which illustrates a concrete slab being held onto the upper side of the hammer frame by the grapple of this invention.

The numeral 48 refers to the grapple assembly of this invention. Grapple assembly 48 includes a mount 50 which is bolted to the forward side of mounting plate 44 by bolts 52 at the upper rearward end of hammer frame 24 as seen in FIG. 6. Mount 50 preferably includes a bracket 54 having a plurality of vertically spaced-apart pin openings 56 formed therein. Mount 50 includes a shaft support 58 having a horizontally disposed shaft 60 rotatably mounted therein. A pair of grapples or grapple arms 60 and 62 have their rearward ends secured to shaft 59. It is preferred that two grapple arms be utilized but it is possible that a single grapple arm will also work. Further, more than two grapple arms may also be used. Preferably, each of the arms 60 and 62 have serrated lower ends 64 and 66 and pointed portions 68 and 70 at the forward ends thereof. Plate 72 is secured to and extends between the grapple arms 60 and 62 as seen in FIG. 2. A plate 74 is also secured to and extends between the grapple arms 60 and 62. Bracket 76 is secured to and extends upwardly from plate 74 as seen in FIG. 2.

The numeral 78 refers to a hydraulic cylinder having its base end pivotally secured to the bracket 54 by pin 80. The base end of the hydraulic cylinder 78 may be selectively adjustably secured to the bracket 54 by the provision of the spaced-apart openings 56. The cylinder rod 82 of hydraulic cylinder 78 is pivotally secured to bracket 78 by pin 84. The hydraulic cylinder 78 is designed to pivot the grapple arms from their open position illustrated in FIG. 7 the closed or gripping position of FIG. 8.

Figure 7:
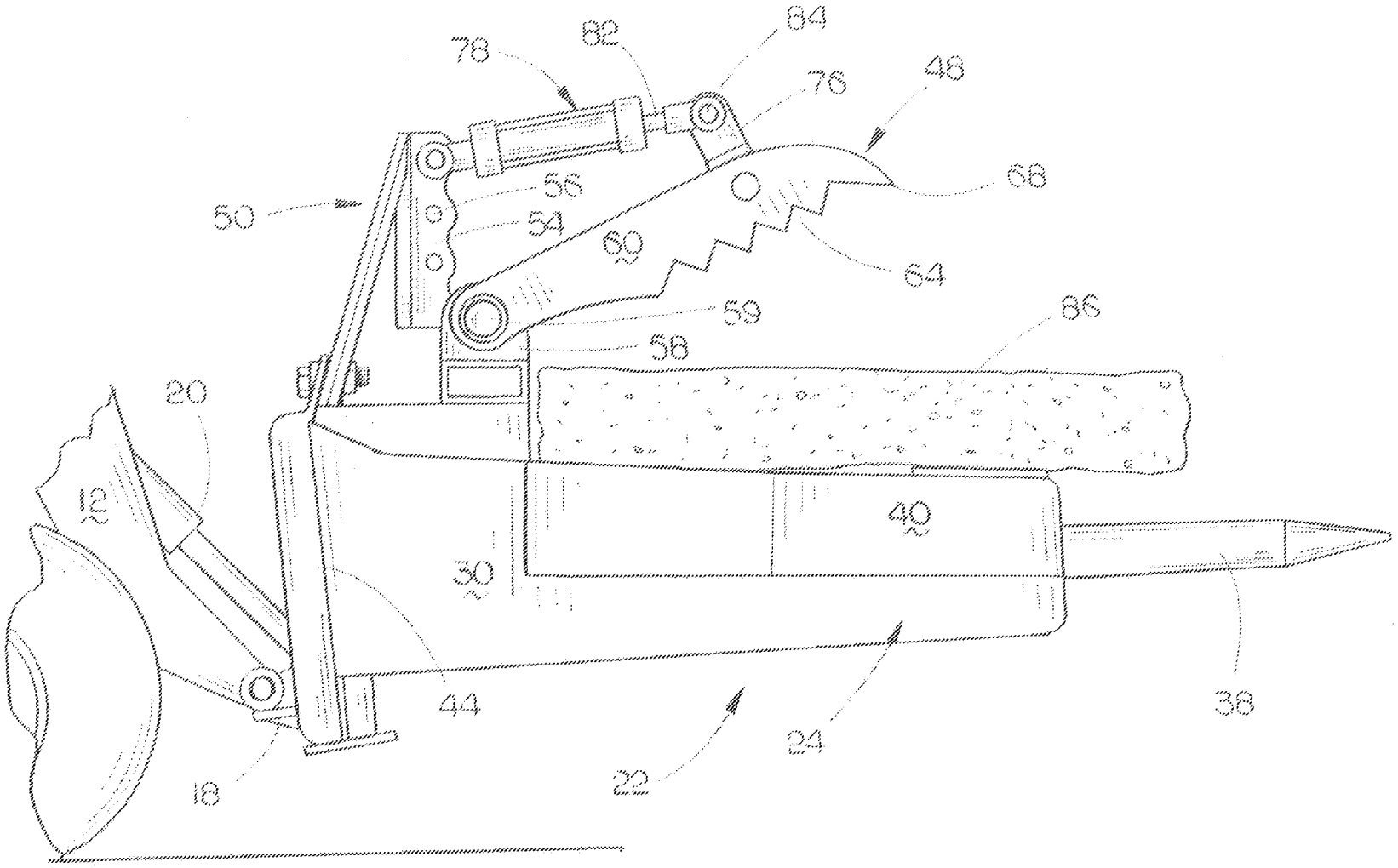
FIG. 7 is a side view illustrating the grapple in an open position.
Figure 8:
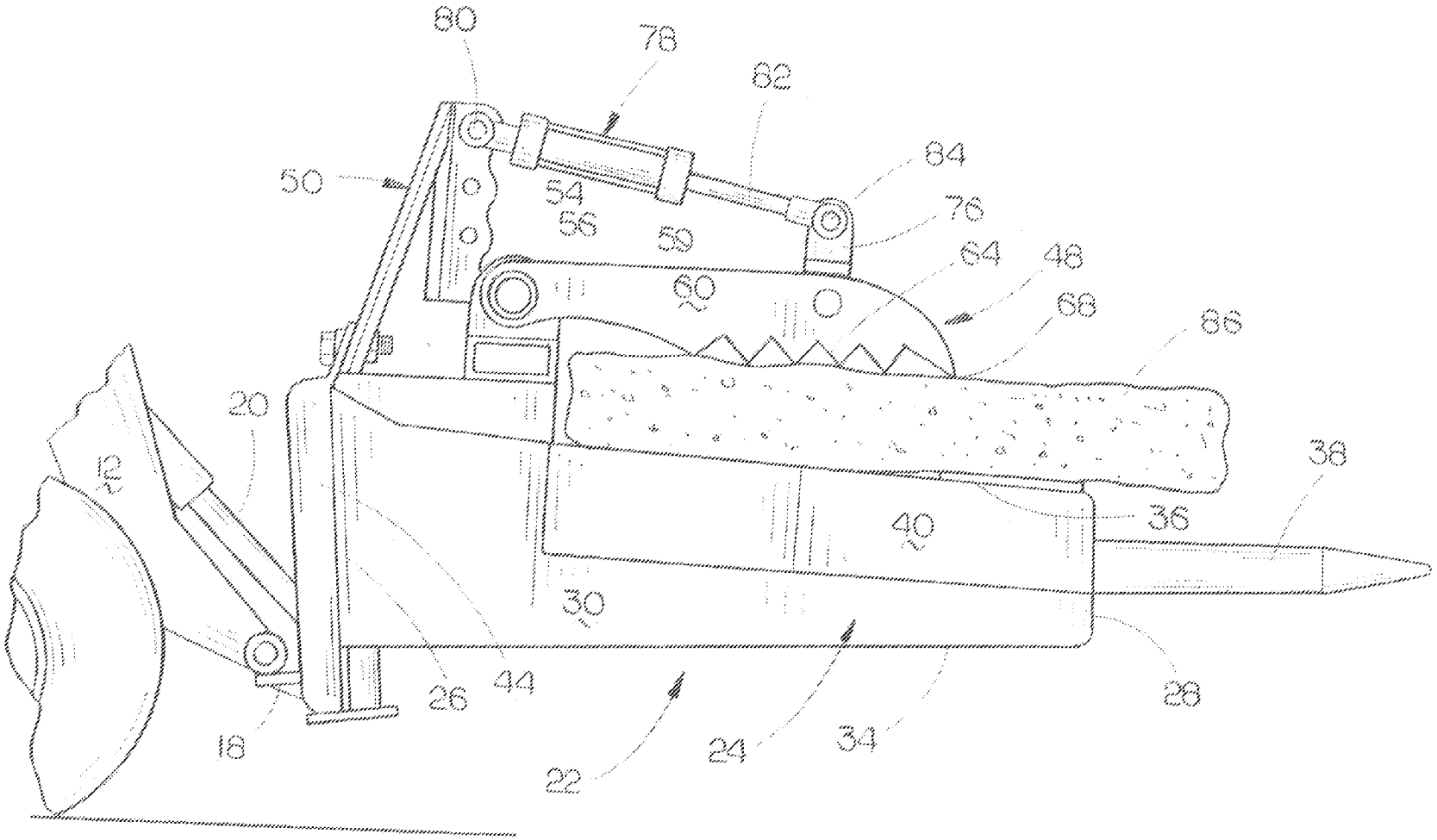
FIG. 8 is a side view illustrating the grapple in a closed or gripping position.

The operation of this invention will now be described. Initially, the concrete hammer will be disposed in a vertically disposed position so that the hammer 38 may drill downwardly through the concrete pavement, sidewalk or slab. Successive holes will be drilled around a slab section so that the slab section may be separated from the remainder of the concrete pavement, sidewalk, etc. When a six foot by eight foot section 86 has been drilled, the loader 10 will be positioned adjacent the drilled slab section with the concrete hammer 22 being pivoted so that the hammer 38 and the frame 24 of the concrete hammer 22 may be pushed or forced downwardly beneath the drilled slab section 86 and will be positioned between the top of the frame 24 of the hammer 22 and the open grapple arms 60 and 62. When the separated or drilled slab section 86 has reached the position such as seen in FIG. 7, the hydraulic cylinder 78, which is connected to the hydraulic system of the loader 10, will be extended so that the grapple arms 60 and 62 are moved downwardly into engagement with the slab section 86 as illustrated in FIGS. 6 and 8. Grapple arms 60 and 62 positively maintain the slab 86 on top of the frame 24 with the wings 40 and 42 adding to the stability of the slab section on the frame 24. The slab 86 is then lifted upwardly and moved to an adjacent truck or the like so that the slab 86 may be lifted upwardly by the boom arms 12 and 14 to position the slab 86 over the open upper end of a truck box or the like. At that time, the hammer 22 will then be pivoted so that the forward end of the hammer frame is lower than the rearward end of the hammer frame. At that time, the hydraulic cylinder 78 will be retracted which will cause the grapple arms 60 and 62 to move out of engagement with the slab 86 so that the slab 86 may slide downwardly from the hammer frame 24 into the truck box.

It can therefore be seen that a novel apparatus has been provided for lifting a slab from payment, sidewalks, etc. and move the same to a truck or transport. By separating a large slab such as a six foot by eight foot slab, it is not necessary to further demolish the separated slab prior to its disposal. It can therefore be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

I claim:

1. A concrete demolishing and removal apparatus for use with a skid-steer loader with the skid-steer loader including a pair of forwardly extending boom arms with the boom arms having a first quick-attach assembly pivotally secured, about a horizontal axis, thereto, comprising:

a second quick-attach assembly for attachment to said first quick-attach assembly;

said second quick-attach assembly including a mounting plate having a rearward side and a forward side;

said mounting plate being selectively pivotally movable by said first quick-attach assembly between a first position to a second position;

said mounting plate being generally upright and tipped back when in said first position;

said mounting plate being generally horizontally disposed when in said second position;

a concrete hammer assembly including an elongated support frame, having a forward end, a rearward end, a first side, a second side an upper end, and a lower end;

said rearward end of said hammer assembly being fixed to said mounting plate and which extends therefrom;

said forward end of said hammer assembly having an elongated hammer spike extending therefrom which is parallel to the longitudinal axis of said support frame;

a grapple mount operatively secured to said upper end of said support frame rearwardly of said forward end thereof;

at least one elongated grapple member having a rearward end and a forward end;

said rearward end of said at least one grapple member being pivotally secured, about a horizontal axis, to said grapple mount so that said at least one grapple member is selectively pivotally movable between a first open position and a second closed position with respect to said support frame;

said at least one grapple member, when in said open position, permitting a separated concrete slab to be positioned between said at least one grapple member and said support frame;

said at least one grapple member, when in said closed position, engaging the separated concrete slab positioned between said grapple member and said support frame so that the concrete slab may be placed in a body of a vehicle for transport.

2. The combination of claim 1 wherein a plurality of spaced-apart grapple members are pivotally secured to said grapple mount.

3. The combination of claim 2 wherein said grapple members are pivotally moved between said open and closed positions by a hydraulic cylinder.

4. The combination of claim 1 wherein said support frame has a first wing portion which extends laterally outwardly from said upper end of said support frame at said first side of said support frame and wherein said support frame has a second wing portion which extends laterally outwardly from said upper end of said support frame at said second side of said support frame.

5. A concrete demolishing and removal apparatus for use with a skid-steer loader with the skid-steer loader including a pair of forwardly extending boom arms having a first quick-attach assembly pivotally secured, about a horizontal axis, thereto, comprising:

a second quick-attach assembly for attachment to said first quick-attach assembly;

a concrete hammer assembly including an elongated support frame, with the support frame having a forward end, a rearward end, a first side, a second side an upper end, and a lower end;

said rearward end of said hammer assembly being operatively secured to said second quick-attach assembly;

said forward end of said hammer assembly having an elongated hammer spike extending therefrom which is parallel to the longitudinal axis of said support frame;

a grapple mount operatively secured to said upper end of said support frame rearwardly of said forward end thereof;

at least one elongated grapple member having a rearward end and a forward end;

said rearward end of said at least one grapple member being pivotally secured, about a horizontal axis, to said grapple mount so that said at least one grapple member is selectively pivotally movable between a first open position and a second closed position with respect to said support frame;

said at least one grapple member, when in said open position, permitting a separated concrete slab to be positioned between said at least one grapple member and said support frame;

said at least one grapple member, when in said closed position, engaging the separated concrete slab positioned between said grapple member and said upper end of said support frame so that the concrete slab may be placed in a body of a vehicle for transport.

6. The combination of claim 5 wherein a plurality of spaced-apart grapple members are pivotally secured to said grapple mount.

7. The combination of claim 6 wherein said grapple members are pivotally moved between said open and closed positions by a hydraulic cylinder.

8. The combination of claim 5 wherein said support frame has a first wing portion which extends laterally outwardly from said upper end of said support frame at said first side of said support frame and wherein said support frame has a second wing portion which extends laterally outwardly from said upper end of said support frame at said second side of said support frame.

9. A concrete demolishing and removal apparatus for use with a vehicle with the vehicle including at least one forwardly extending boom arm having a first quick-attach assembly pivotally secured, about a horizontal axis, thereto, comprising:

a second quick-attach assembly for attachment to said first quick-attach assembly;

a concrete hammer assembly including an elongated support frame, with the support frame having a forward end, a rearward end, a first side, a second side an upper end, and a lower end;

said rearward end of said hammer assembly being operatively secured to said second quick-attach assembly;

said forward end of said hammer assembly having an elongated hammer spike extending therefrom which is parallel to the longitudinal axis of said support frame;

a grapple mount operatively secured to said upper end of said support frame rearwardly of said forward end thereof;

at least one elongated grapple member having a rearward end and a forward end;

said rearward end of said at least one grapple member being pivotally secured, about a horizontal axis, to said grapple mount so that said at least one grapple member is selectively pivotally movable between a first open position and a second closed position with respect to said upper end of said support frame;

said at least one grapple member, when in said open position, permitting a separated concrete slab to be positioned between said at least one grapple member and said upper end of said support frame;

said at least one grapple member, when in said closed position, engaging the separated concrete slab positioned between said grapple member and said upper end of said support frame so that the concrete slab may be placed in a body of a vehicle for transport.

10. The combination of claim 9 wherein a plurality of spaced-apart grapple members are pivotally secured to said grapple mount.

11. The combination of claim 10 wherein said grapple members are pivotally moved between said open and closed positions by a hydraulic cylinder.

12. The combination of claim 9 wherein said support frame has a first wing portion which extends laterally outwardly from said upper end of said support frame at said first side of said support frame and wherein said support frame has a second wing portion which extends laterally outwardly from said upper end of said support frame at said second side of said support frame.

* * * * *